US012186796B2

(12) United States Patent
Stoppiglia et al.

(10) Patent No.: US 12,186,796 B2
(45) Date of Patent: Jan. 7, 2025

(54) METHOD FOR MANUFACTURING LONG METAL STOPPER CAPS COMPRISING A SKIRT HAVING A CONSTANT THICKNESS

(71) Applicant: CONSTELLIUM ROLLED PRODUCTS SINGEN GMBH & CO.KG, Singen (DE)

(72) Inventors: Herve Stoppiglia, Meylan (FR); Regine Debreux, Vorepe (FR); Emilie Lae, Saint Jean de Moirans (FR)

(73) Assignee: CONSTELLIUM ROLLED PRODUCTS SINGEN GMBH & CO.KG, Singen (DE)

( * ) Notice: Subject to any disclaimer, the term of this patent is extended or adjusted under 35 U.S.C. 154(b) by 299 days.

(21) Appl. No.: 17/609,184

(22) PCT Filed: May 6, 2020

(86) PCT No.: PCT/EP2020/062546

§ 371 (c)(1),
(2) Date: Nov. 5, 2021

(87) PCT Pub. No.: WO2020/225288

PCT Pub. Date: Nov. 12, 2020

(65) Prior Publication Data

US 2022/0324010 A1 Oct. 13, 2022

(30) Foreign Application Priority Data

May 9, 2019 (FR) ..... 1904810
Nov. 8, 2019 (FR) ..... 1912577

(51) Int. Cl.

| | |
|---|---|
| ***B21D 51/50*** | (2006.01) |
| ***B21D 22/28*** | (2006.01) |
| ***B65D 41/04*** | (2006.01) |

(52) U.S. Cl.
CPC ..... *B21D 51/50* (2013.01); *B21D 22/28* (2013.01); *B65D 41/04* (2013.01)

(58) Field of Classification Search
CPC ..... B21D 51/50; B21D 51/44; B21D 51/48; B21D 22/28
See application file for complete search history.

(56) References Cited

U.S. PATENT DOCUMENTS

| | | | | |
|---|---|---|---|---|
| 6,403,173 | B1 | 6/2002 | Granger et al. | |
| 10,618,097 | B2 | 4/2020 | Rostaing et al. | |
| 10,787,295 | B2 | 9/2020 | Laszczyk et al. | |
| 2016/0288195 | A1* | 10/2016 | Rostaing | B65D 41/04 |
| 2017/0283126 | A1* | 10/2017 | Laszczyk | B65D 41/62 |

FOREIGN PATENT DOCUMENTS

| | | | |
|---|---|---|---|
| EP | 3188855 | A1 | 7/2017 |
| FR | 2856982 | A1 | 1/2005 |
| JP | 2002/143934 | A | 5/2002 |
| WO | 2015/075324 | A1 | 5/2015 |

OTHER PUBLICATIONS

WO 2018191828A1 (Year: 2018).*
International Search Report of International Application No. PCT/EP2020/062546, mailed Aug. 14, 2020.

* cited by examiner

*Primary Examiner* — Debra M Sullivan
(74) *Attorney, Agent, or Firm* — McBee Moore & Vanik IP, LLC

(57) ABSTRACT

A Method for manufacturing metal sealing caps comprising a sequence of steps is provided herein.

17 Claims, 5 Drawing Sheets

[Fig. 1]
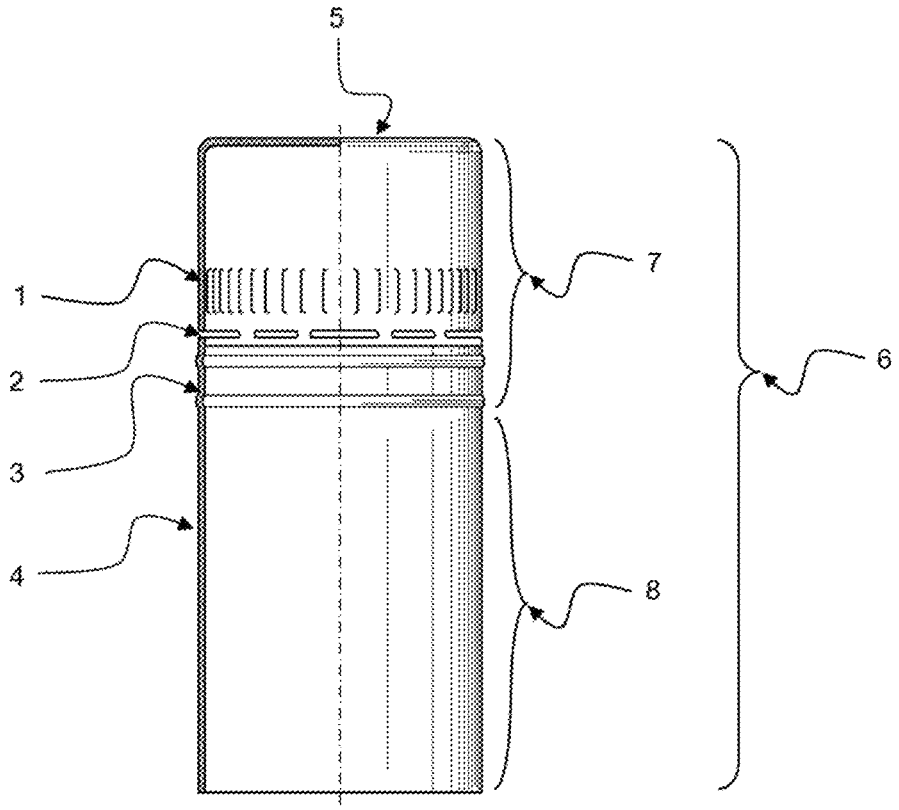

[Fig. 2]
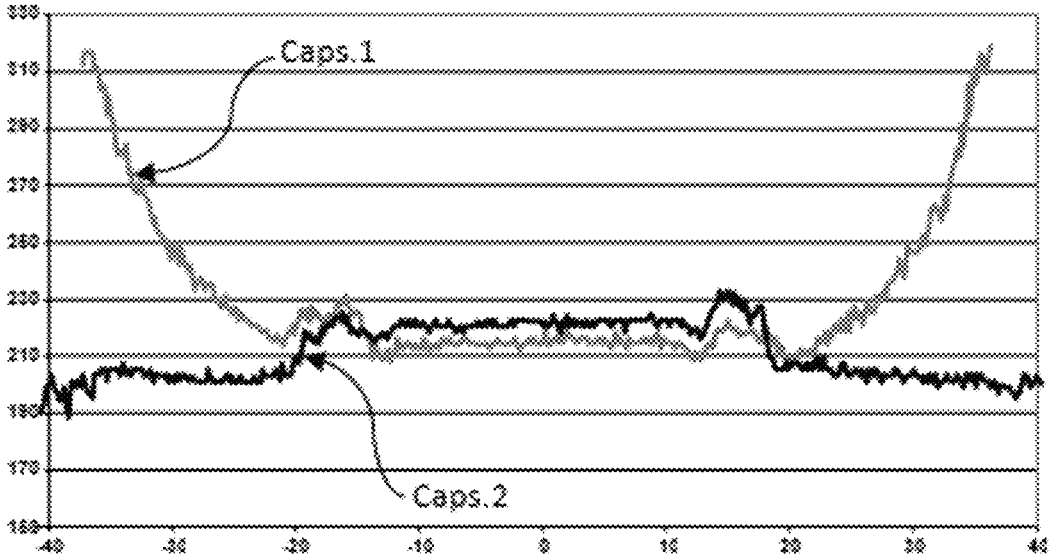
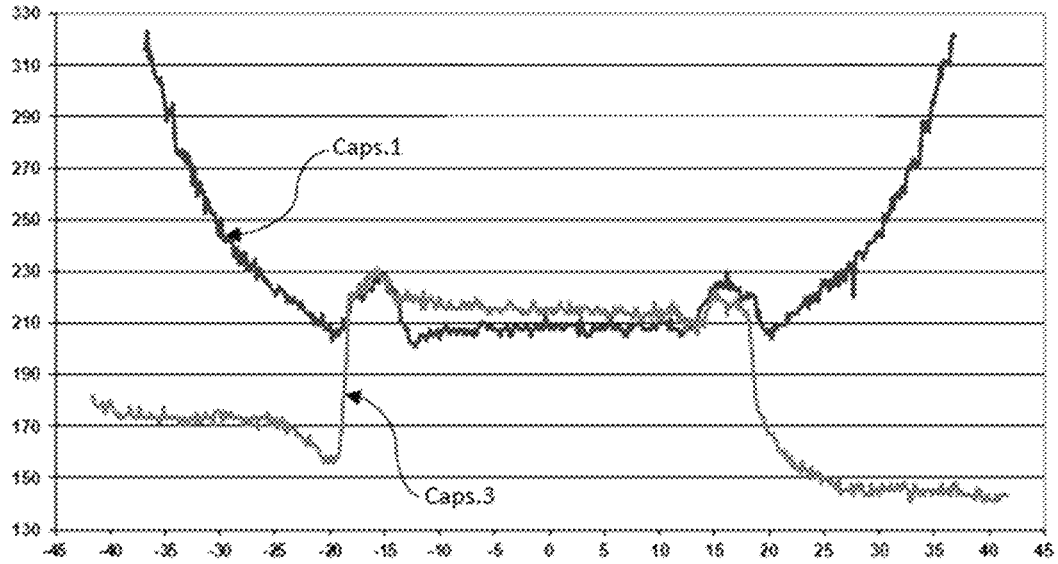

[Fig. 3]
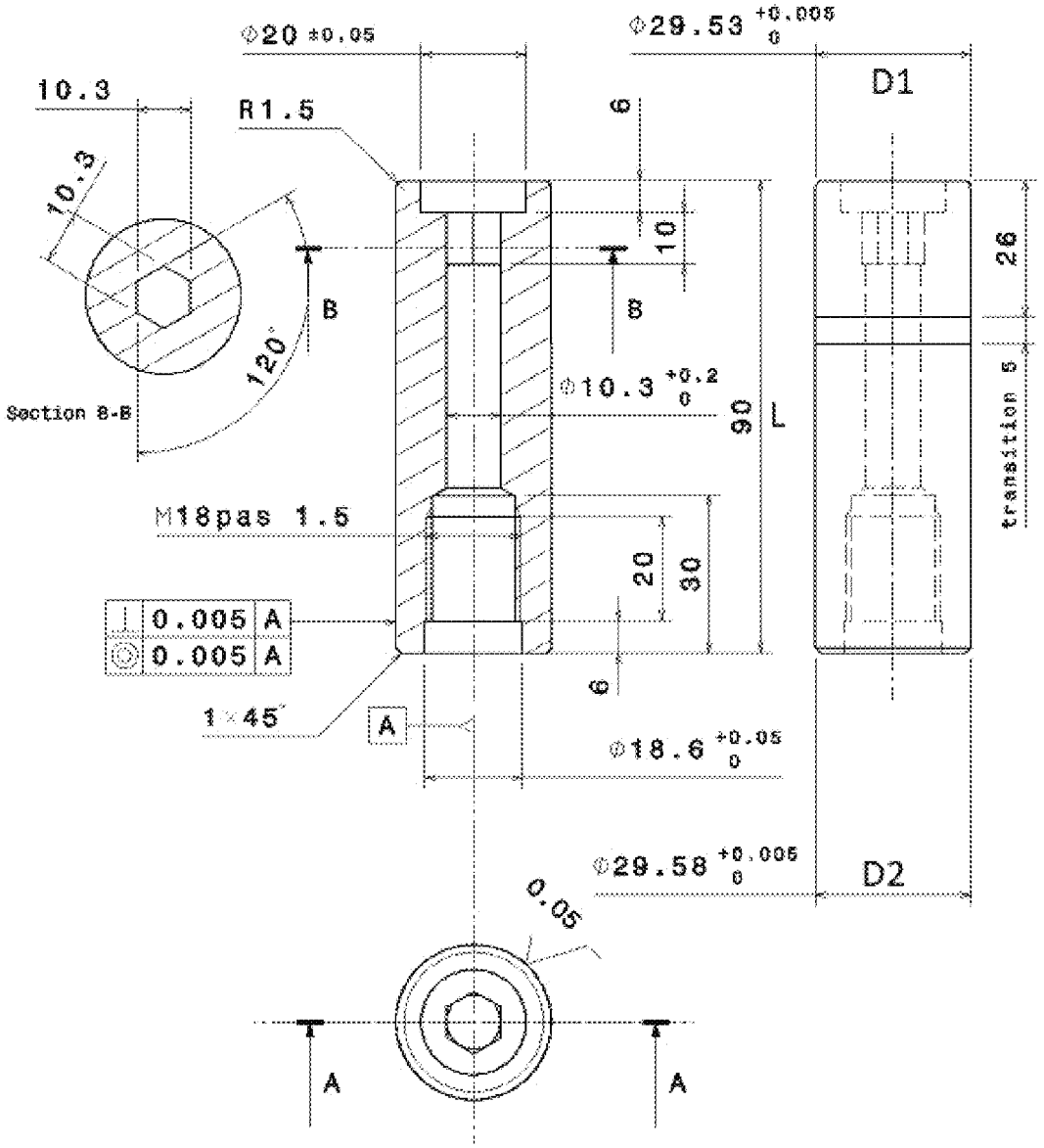

[Fig. 4]
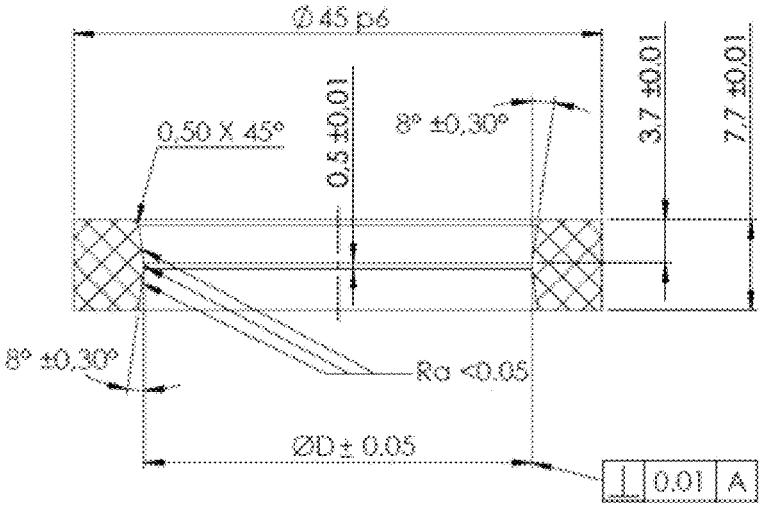
[Fig. 5]
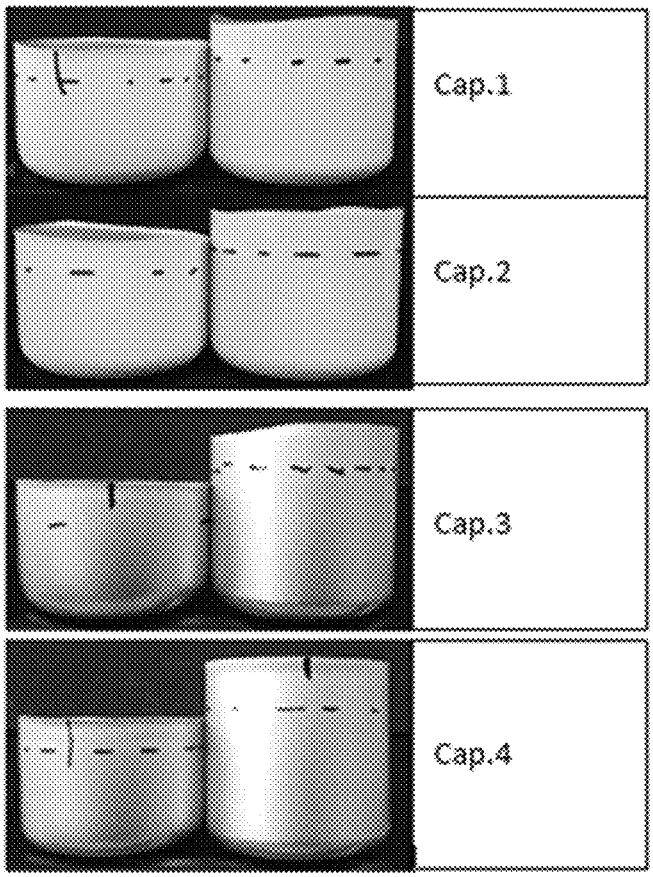

[Fig. 6]
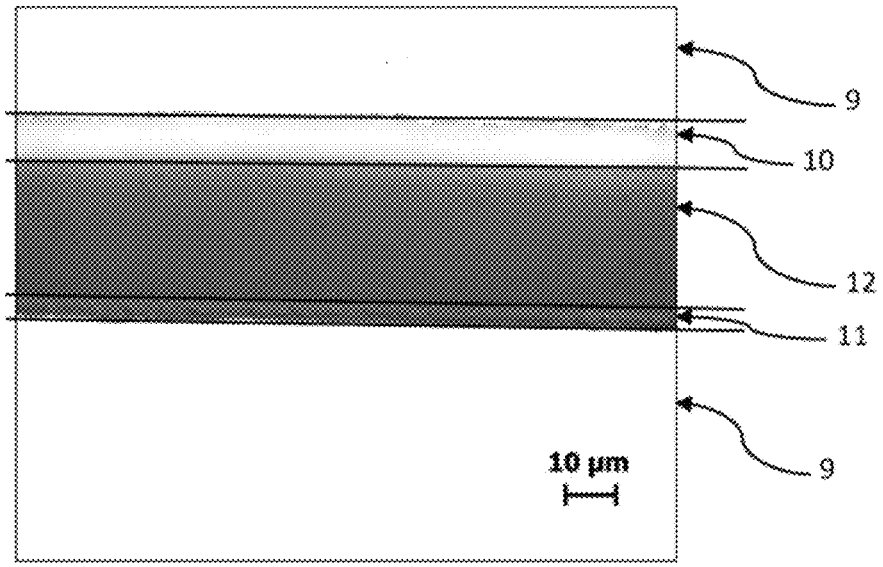

METHOD FOR MANUFACTURING LONG METAL STOPPER CAPS COMPRISING A SKIRT HAVING A CONSTANT THICKNESS

CROSS-REFERENCE TO RELATED APPLICATIONS

This application is the National Stage entry of International Application No. PCT/EP2020/062546, filed 6 May 2020, which claims priority to French Application No. 1904810, filed 9 May 2019 and French Application No. 1912577, filed 8 Nov. 2019.

BACKGROUND

Field

FIELD OF THE INVENTION

The invention relates to the field of sealing caps including a metal outer shell made from aluminum alloy and in particular screw caps having a long skirt so that, when the cap is unscrewed, the bottom of the skirt remains in place on the neck of the bottle. These caps are intended for sealing receptacles, mainly glass bottles containing alcoholic drinks and especially wine or spirits.

The invention relates more particularly to a method for manufacturing such caps making it possible to obtain caps having a skirt with a thickness less than the thickness of the blank and constant over the entire length thereof, as well as a skirt having a continuous inner and outer layer of varnish intact over the entire length of the skirt.

Description of Related Art

Sealing caps made from aluminum alloy are typically manufactured in the following manner:

- A stamping press forms cap preforms from a strip or sheet, also referred to as a format, cut into blanks, varnished on both faces thereof, with a typical thickness ranging from 0.15 to 0.25 mm without taking into account the thickness of the varnish. Depending on the height of the skirt (the length of the cap preform), one to three stamping passes may be necessary.
- These preforms are degreased in a stove at high temperature, typically from 180 to 210° C., for a time ranging from 3 to 5 minutes, in order to eliminate the stamping lubricant.
- They are next varnished over the entire outer surface thereof and are stoved in order to cure the varnish.
- These varnished preforms are printed on the skirt, typically in screen printing, a method known to a person skilled in the art by the term "offset", with a final drying of the inks in a stove.
- An overprinting varnish is finally applied in order to protect the printing, said varnish being dried when passing through a stove.
- The preform thus obtained is provided with a seal and/or a threaded inner plastic insert.

It should be noted that all the aluminum alloys referred to hereinafter are, unless mentioned to the contrary, designated in accordance with the designations defined by the Aluminum Association in the Registration Record Series that it publishes regularly.

It should also be noted that all the percentages are expressed in percentages by mass, unless indicated to the contrary.

Stated Problem

Thus the long caps are obtained by a method comprising a plurality of stamping passes. However, these successive stamping passes result in a cap wherein the thickness of the skirt is irregular. This irregularity may pose problems when the cap is used, for example by sometimes making it more difficult or sometimes too easy to break the bridge line by the user. The bridge line is the line along which the cap breaks when a user twists it on itself to open the bottle. It is sought to obtain a cap that is more reliable on opening, for which the opening torque is less variable, more reproducible.

Some caps can be obtained by a stamping step followed by a drawing step, but these are not long caps and the method for obtaining them seeks to solve a particular problem:

- keeping a bright surface identical over all the parts of the cap, from the head to the skirt (see for example the patent application of Constellium France WO 2015/075324);
- keeping a textured surface on the head and obtaining a bright surface identical over the entire skirt (see for example the patent of Constellium Neuf-Brisach EP 3 188 855);
- obtaining a discontinuous layer of varnish, present only at certain given locations (see for example the patent of Pechiney Emballage Alimentaire U.S. 6,403,173).

For reasons of industrial efficiency, it is required for the varnish to be added before the stamping and drawing steps. However, it is not certain that the varnish applied before the stamping and drawing will keep its integrity over its entire surface of the cap, and in particular over the length of the skirt of the cap, inside and outside the cap.

Moreover, it is necessary to obtain a thickness of the skirt that is constant but not too fine so that the skirt keeps good mechanical properties and can receive the various shapings necessary for use of the cap, in particular the molding 1, the crimping line 3 (for attaching the cap to the bottle) and the bridge line 2, as illustrated on FIG. 1.

SUMMARY

The present invention has many advantages: making the thickness of the skirt uniform over the entire height thereof while minimizing the quantity of material used, or allowing the manufacture of higher caps without increasing the quantity of material, while guaranteeing good mechanical properties and a continuous layer of varnish intact over the entire length of the skirt of the cap.

The invention aims to solve the problem of compromise between the regularity of thickness of the skirt of the cap while guaranteeing the integrity of the varnish applied before stamping and drawing over the entire length of the skirt, and while guaranteeing good mechanical properties of the skirt, by proposing a method that can be implemented under industrially economical conditions for the market of long sealing caps for drinks bottles.

OBJECT OF THE INVENTION

The invention relates to a method for manufacturing metal sealing caps comprising the following successive steps:

a) the provision of a strip or sheet, of aluminum alloy, preferably having a roughness Ra in accordance with NF EN ISO 4287 standard (December 1998) of 0.2 to 0.8 μm, more preferentially from 0.2 to 0.6 μm, coated on both faces with a layer of varnish;

b) a first cutting operation to obtain disks referred to as blanks;

c) a step of stamping said blanks, in one or more passes, preferably at least two passes, more preferentially two or three passes, even more preferentially two passes, preferably using a stamping lubricant, so as to form a stamped preform, comprising a head and a skirt;

c') at least one drawing step consisting of passing the stamped preform through at least one drawing ring in order to lengthen the metal and make it thinner, so as to form a cap comprising a head preferably having a diameter of 20 to 40 mm, more preferentially from 25 to 35 mm, a skirt preferably having a length of 40 to 85 mm, more preferentially from 40 to 83 mm, even more preferentially from 40 to 80 mm, even more preferentially from 40 to 70 mm, and even more preferentially from 45 to 65 mm, the top of the cap being on the head side and the bottom of the cap on the side where the skirt ends, the skirt having a constant thickness of 0.12 to 0.27 mm, preferably from 0.15 to 0.25 mm, over at least 20% of the length thereof starting from the bottom of the cap, and preferably up to 60% of its length starting from the bottom of the cap, and comprising a continuous layer of varnish intact over the entire length of the skirt, on both the inside and the outside of the cap;

d) an optional step of degreasing said cap;

e) an optional step of printing and/or finishing varnishing for protection and/or decoration.

Another object of the invention is a metal sealing cap manufactured by the method according to the present invention, which comprises a head, a skirt, the top of the cap being on the head side and the bottom of the cap on the side where the skirt ends, characterized in that the thickness of its skirt is constant over at least 20% of its length starting from the bottom of the cap (and preferably up to 60% of its length starting from the bottom of the cap) and is from 0.12 to 0.27 mm, preferably from 0.15 to 0.25 mm, and in that it comprises a continuous layer of varnish intact over the entire length of the skirt, both inside and outside the cap, the head of the cap preferably having a diameter of 20 to 40 mm, more preferentially from 25 to 35 mm, and the skirt of the cap preferably having a length of 40 to 85 mm, more preferentially from 40 to 83 mm, even more preferentially from 40 to 80 mm, even more preferentially from 40 to 70 mm, and even more preferably from 45 to 65 mm.

Another object of the invention is a punch for stamping and drawing an aluminum alloy blank, characterized in that it has two different diameters over its length, a first diameter D1 corresponding to the part of the punch coming into contact first with the metal to be stamped and then drawn and a second diameter D2 corresponding to the part of the punch coming into contact secondly with the metal to be stamped and then drawn, the two parts having different diameters being connected together by a conical transition part, the first diameter D1 being less than the second diameter D2, the difference in diameter between D1 and D2 being from 0.02 to 0.1 mm, preferably from 0.03 to 0.07 mm.

DESCRIPTION OF THE FIGURES

FIG. 1 is a diagram of a long cap. The reference 1 shows the molding, the reference 2 the bridge line, the reference 3 the crimping line, the reference 4 the cap, the reference 5 the head of the cap, the reference 6 the skirt of the cap, which comprises a top part (reference 7) and a bottom part (reference 8).

FIG. 2 is a graph illustrating the change in the thickness of a cap according to the part of the cap in question. The X-axis corresponds to the curvilinear abscissa, i.e. the distance from the centre of the head of the cap (0) as far as the ends of the skirt (−40 and 40), in mm. The Y-axis corresponds to the thickness of metal, in μm. The reference Cap.1 corresponds to a cap after stamping alone. The references Cap.2 and Cap.3 correspond to two caps after stamping and drawing according to the method of the present invention.

FIG. 3 shows an advantageous punch according to the present invention. The reference L represents the total length of the punch, the reference D1 the first diameter and the reference D2 the second diameter, as described below. The numerical values are given by way of example. The references A and B represent cutting planes.

FIG. 4 shows a drawing ring as used in the examples. D corresponds to the diameter of the drawing rings given in the table of examples.

FIG. 5 is a photograph of the caps produced according to the example.

FIG. 6 is a micrograph of a varnished metal blank before stamping and drawing, as used in the following example. The reference 9 corresponds to the aluminum alloy, the reference 10 to the external varnish of a first sample, the reference 11 to the internal varnish of another sample and the reference 12 to the resin in which the samples have been coated.

DETAILED DESCRIPTION OF A PREFERRED EMBODIMENT

The object of the invention is a method for manufacturing metal sealing caps, comprising the following successive steps:

a) the provision of a strip or sheet, of aluminum alloy, preferably having a roughness Ra in accordance with NF EN ISO 4287 standard (December 1998) of 0.2 to 0.8 μm, more preferentially from 0.2 to 0.6 μm, coated on both faces with a layer of varnish;

b) a first cutting operation to obtain disks referred to as blanks;

c) a step of stamping said blanks, in one or more passes, preferably at least two passes, more preferentially two or three passes, even more preferentially two passes, preferably using a stamping lubricant, so as to form a stamped preform, comprising a head and a skirt;

c') at least one drawing step consisting of passing the stamped preform through at least one drawing ring in order to lengthen the metal and make it thinner, so as to form a cap comprising a head preferably having a diameter of 20 to 40 mm, more preferentially from 25 to 35 mm, a skirt preferably having a length of 40 to 85 mm, more preferentially from 40 to 83 mm, even more preferentially from 40 to 80 mm, even more preferentially from 40 to 70 mm, and even more preferentially from 45 to 65 mm, the top of the cap being on the head side and the bottom of the cap on the side where the skirt ends, the skirt having a constant thickness of 0.12 to 0.27 mm, preferably from 0.15 to 0.25 mm, over at least 20% of the length thereof starting from the bottom of the cap(and preferably up to 60% of its length starting from the bottom of the cap), and comprising a continuous layer of varnish intact over the entire length of the skirt, on both the inside and the outside of the cap;

d) an optional step of degreasing said cap;

e) an optional step of printing and/or finishing varnishing for protection and/or decoration.

Preferably, the strip or sheet of step a) is coated on both faces with a single layer of varnish. Typically, the blank has a thickness of 0.15 to 0.35 mm without taking the varnish into account. Preferably, the blank has a diameter of 80 to 96 mm. According to the present invention, the blank may have two different diameters. According to a first variant, the blank may have a diameter of 90 to 96 mm, which corresponds to what normally takes place in the field of long caps. This variant can make it possible to produce longer caps than what normally happens in the field of long caps, for example from 60 to 105 mm. The additional length can thus be cropped and then recycled. The advantage of the present invention is here making it possible not to change all the production tools while allowing reprocessing of the unused metal to produce caps of the same length but having a lesser thickness than what normally happens in the field of long caps.

According to a second variant, the blank may have a diameter of 80 to 92 mm, which corresponds to a smaller diameter than what normally happens in the field of long caps. This variant can make it possible to produce caps with the same length as what normally happens in the field of long caps, for example from 40 to 70 mm. The advantage of the present invention is here allowing a saving in metal for producing caps of the same length but having a lesser thickness than what normally happens in the field of long caps.

According to a variant of the present invention, the inventors had determined a formula, which could for example serve as a tool on the industrial scale, for making it possible to determine, with a margin of error of +/−0.1 mm, the diameter D of the starting blank according to the diameter B of the height H of the cap, as well as the initial thickness of metal E0, the thickness of the skirt of the cap after drawing E and the drawing rate Red. It should be noted that the drawing rate Red is equal to 1−(E/E0). The formula results from the equation stating that the volume of metal of the starting blank ($E0\cdot\pi\cdot D^2/4$) is equal to the volume of metal of the final cap ($[E0\cdot\pi\cdot B^2/4]+[H\cdot\pi\cdot E]$). It should be noted that E is equal to E0·(1−Red). The formula is then as follows, after simplification:

$$D^2=B^2+4\cdot B\cdot H\cdot(1-Red) \quad \text{[Formula 1]}$$

Wherein D is the diameter of the starting blank in mm, B is the diameter of the cap in mm, H is the height of the cap in mm and Red is the drawing rate.

Preferably, the stamped preform is axisymmetric in an axial direction of said preform. The stamped preform preferably has a diameter of 27 to 31 mm and/or a thickness of 0.15 to 0.35 mm.

According to the present invention, "constant thickness" means when the variation in thickness over the height of the skirt is less than 5%, preferably less than 3%, with respect to the total thickness of the skirt without counting the varnish. By way of comparison, the variation in thickness over the height of the skirt after stamping is generally approximately 20% with respect to the total thickness of the skirt.

Generally, in the present description, the thicknesses of metal mean excluding the varnish.

The minimum drawing rate is justified by the fact that it must at a minimum bring the thickness of the whole of the skirt substantially uniformly to the value of the minimum thickness obtained locally after stamping. The latter depends on the stamping conditions (roughness of the tool, clearance, pressure of the blank holder, lubrication).

It should be noted that the stamping step thickens the skirt, non-uniformly over the length of the skirt (see FIG. 2). Because of this, the thickness of the skirt of a stamped preform, after stamping and before drawing, is variable over the length of the skirt, and generally increasing from the head of the preform towards the bottom of the skirt. The thickness of the skirt of a stamped preform, whatever the length in question, is generally greater than the initial thickness of the blank before stamping.

It should be noted that the sheet, the strip and the blank have the same thickness, i.e. the initial thickness EQ.

Since the stamping step leads to a thickening of the skirt, a drawing rate may be negative, equal to 0% or positive. A drawing rate of 0% means that the initial thickness of the blank is found uniformly on the skirt. A negative drawing rate means that the thickness of the skirt is made uniform by the drawing step but without reducing this thickness to the same level as the initial thickness of the blank. A positive drawing rate means that the thickness of the skirt is made uniform by the drawing step by reducing this thickness to a level less than the initial thickness of the blank.

According to the present invention, the drawing rate is preferably greater than or equal to 0%, i.e. the initial thickness of the blank is found at a minimum. According to the most common mode, the drawing rate (1−file thickness E/initial thickness E0 of the sheet or of the strip or of the blank) is preferably greater than or equal to 2.5%.

The maximum drawing rate is related to the limit of drawability before rupture (of the metal and/or of the varnish), intrinsic to the aluminum alloy/varnish complex, which must not be exceeded during the drawing of the bottom of the skirt, the thickest region after stamping. For example, in the case of an alloy of the AA3105 type, the maximum industrially acceptable drawing rate is 40%. Then a maximum drawing rate of substantially 30% is obtained to take account in particular of the limits of the varnish.

According to a preferential mode, the drawing rate is less than or equal to 30%.

The varnish is preferably stampable, i.e. it is not damaged during the stamping and drawing, and remains present and of good quality over the entire surface of the cap, from the head to the skirt. It is expected of the varnish that it forms a continuous intact layer over the entire length of the skirt, both inside and outside, even after the stamping and drawing.

By way of example, the internal varnish, i.e. the varnish applied on the side of the blank that will become the inside of the cap, may be an acrylic varnish, preferably having a spread of 2 to 6 mg/m$^2$, more preferentially from 3 to 5 mg/m$^2$. This internal varnish must generally be suitable for food contacts. It can be applied for example in a thickness of 1 to 6 μm, preferably from 2 to 5 μm. Its color may for example be gold, silvery or white.

By way of example, the external varnish, i.e. the varnish applied on the side of the blank that will become the outside of the cap, may be a polyester varnish, preferably having a spread of 3 to 17 mg/m$^2$, more preferentially from 4 to 16 mg/m$^2$. This external varnish may be applied for example in a thickness of 4 to 12 μm, preferably from 5 to 11 μm. The color thereof may for example be gold, silvery or white.

Advantageously, a lubricant may be used for the stamping step. The lubricant is preferably volatile and eliminated by heating.

The same applies with the lubricant used for the stamping which, advantageously, is volatile and eliminated by heating, typically in a through-type furnace or in a stove.

Moreover, the same lubricant may be used for the two stamping and drawing steps.

Preferably, the optionally degreasing step is intended to eliminate the remains of lubricant, to form a degreased cap suitable for optionally being varnished. The degreasing may be implemented using any known method. For example, the degreasing may be thermal or chemical, preferably thermal. Thermal degreasing may for example be implemented in a stove.

The thermal degreasing temperature is preferably from 180 to 210° C. The duration of thermal degreasing is preferably from 3 to 5 min. This degreasing step is optional, since it is mainly useful in the case where the method comprises a printing and/or varnishing step. Thus, generally, either the two steps are present, or the two steps are absent. Preferably, the method does not comprise the steps d) of degreasing and e) of printing and/or varnishing.

Advantageously, the stamping and drawing steps are concatenated without any other intermediate step. Even more advantageously, the last stamping step and the drawing step are implemented in one and the same press stroke.

Finally, the aluminum alloy may be, but not exclusively, of the AA3105 type or of the AA8011 type.

Another object of the invention is a metal sealing cap manufactured by the method according to the present invention, which comprises a head and a skirt, the top of the cap being on the head side and the bottom of the cap on the side where the skirt ends, characterized in that the thickness of its skirt is constant over at least 20% of its length starting from the bottom of the cap and is from 0.12 to 0.27 mm, preferably from 0.15 to 0.25 mm, and in that it comprises a continuous intact layer of varnish over the entire length of the skirt, both inside and outside the cap.

The thickness of the skirt of the cap is preferably constant up to 60% of its length starting from the bottom of the cap. The diameter of the head of the cap is preferably from 20 to 40 mm, more preferentially from 25 to 35 mm. The length of the skirt of the cap is preferably from 40 to 85 mm, more preferentially from 40 to 83 mm, even more preferentially from 40 to 80 mm, even more preferentially from 40 to 70 mm, and even more preferentially from 45 to 65 mm. The cap according to the present invention has all the features presented in relation to the method according to the present invention.

The cap is preferably axisymmetric in an axial direction of said cap. The cap preferably comprises a head having a thickness corresponding to the initial thickness of the blank, i.e. generally from 0.15 to 0.35 mm.

According to an advantageous embodiment, it is possible to use a punch such as the one illustrated by FIG. 3, having a length L and two different diameters over its length, the diameter of the part of the punch coming into contact first with the metal to be stamped and then to be drawn (=first diameter D1) being less than the diameter of the part of the punch coming into contact secondly with the metal to be stamped and then drawn (=second diameter D2). According to this embodiment, the method according to the present invention uses a stamp for the stamping/drawing step, the punch having two different diameters over the length thereof, a first diameter D1 corresponding to the part of the punch coming into contact first with the metal to be stamped and then drawn and a second diameter D2 corresponding to the part of the punch coming into contact secondly with the metal to be stamped and then drawn, the two parts having different diameters being connected together by a conical transition part, the first diameter D1 being less than the second diameter D2, the difference in diameter between D1 and D2 being from 0.02 to 0.1 mm, preferably from 0.03 to 0.07 mm. The first diameter D1 and the second diameter D2 are preferably from 19 to 39.6 mm. The part having the diameter D1 preferably represents from 25 to 35% of the height of the punch. The part having the diameter D2 preferably represents from 60 to 70% of the height of the punch. The transition part preferably represents from 3 to 7% of the height of the punch. The length L of the punch is, in a manner known to a person skilled in the art, to be adapted with respect to the length of the required skirt. By way of example, D1 may be approximately 29.53 mm, D2 approximately 29.58 mm and the transition part approximately 5 mm. The part having the diameter D1 in this case represents approximately 28.9% of the height of the punch.

This variant would make it possible to vary the thickness of the skirt of the cap, the height of the skirt having a greater thickness than that of the bottom of the skirt. Preferably, according to this variant, the top of the skirt has a thickness of 0.15 to 0.35 mm, more preferentially from 0.12 to 0.27 mm, and the bottom of the skirt has a thickness of 0.12 to 0.27 mm, on the understanding that the thickness of the top of the skirt is greater than the thickness of the bottom of the skirt. It should be noted that the greater thickness of the top part of the skirt would make it possible to guarantee good mechanical strength for implementing the optional molding, the bridge line and the crimping line, as well as good mechanical strength when the bottle is opened by the end user.

Another object of the invention is a punch for stamping and drawing a blank of aluminum alloy, characterized in that it has two different diameters over its length, a first diameter D1 corresponding to the part of the punch coming into contact first with the metal to be stamped and then drawn and a second diameter D2 corresponding to the part of the punch coming into contact secondly with the metal to be stamped and then drawn, the two parts having different diameters being connected together by a conical transition part, the first diameter D1 being less than the second diameter D2, the difference in diameter between D1 and D2 being from 0.02 to 0.1 mm, preferably from 0.03 to 0.07 mm.

The first diameter D1 and the second diameter D2 are preferably from 19 to 39.6 mm. The part having the diameter D1 preferably represents from 25 to 35% of the height of the punch. The part having the diameter D2 preferably represents from 60 to 70% of the height of the punch. The transition part preferably represents from 3 to 7% of the height of the punch. The length of the punch is, in a manner known to a person skilled in the art, to be adapted with respect to the required length of the skirt. By way of example, D1 may be approximately 29.53 mm, D2 approximately 29.58 mm and the transition part approximately 5 mm, the part having the diameter D1 then representing approximately 28.9% of the height of the punch.

In its details, the invention will be understood better by means of the following examples, which however do not have any limitative character.

EXAMPLE EMBODIMENTS

Tests were performed in order to demonstrate the efficacy of the method according to the present invention for obtaining caps having a reduced skirt thickness while keeping a layer of varnish intact over the entire length of the skirt of the cap. In the industrial process, it is in fact important for the layer of varnish to remain intact over the entire surface of the cap, since said cap is then generally subjected to a heat treatment, typically of 2 minutes at 160-180° C., and next to a printing for decorating the walls of the cap. If the layer of varnish is not intact before these steps, the final cap obtained will not meet the aesthetic criteria expected by the customer and the end user.

To check the quality of the layer of varnish, and in particular the presence of this layer of varnish over the entire surface of the cap, a test is performed using copper sulfate. This is a test for porosity to copper sulfate. This test is destructive and generally performed on ten reference caps. The protocol is as described below.

The copper sulfate solution is composed of 50 g of copper sulfate ($CuSO_4$) in the form of crystals to be dissolved in 950 g of demineralized water, to which 20 ml of 36% hydrochloric acid is added. The whole is next mixed with a stirrer.

Implementation of the test requires thermal degreasing. The caps were next placed in a tank and immersed in the copper sulfate solution. The application time was 15 minutes. After this period of time, a simple observation with the naked eye makes it possible to see whether the cap has been attached, each attack zone corresponding to a zone where there is no longer any varnish. The non-attacked zones are of the same color as the original cap, whereas the attacked zones are a rust color.

If there is no attacked surface, then the layer of varnish is present and attacked over the entire surface of the cap.

A plurality of caps, stamped in a single pass and then drawn, were produced according to the protocol described below. Metal strips made from aluminum alloy of the AA8011 type, having a roughness Ra in accordance with NF EN ISO 4287 standard (December 1998) of 0.3 μm and an initial thickness E0 without varnish as given in Table 1 below, were cut to the format 100 mm×300 mm. Said formats were next cut into blanks having a diameter of 64 mm by means of a cutting ring.

The blanks were varnished with a color varnish or a varnish of the PPG-3117-3003 type for the inside of the caps, and with a varnish as described in Table 1 below for the outside of the caps. The stamping step was implemented on said varnished blanks in order to obtain stamped preforms, with tools having the following characteristics (BUP 200): diameter of the punch of 33 mm and diameter of the stamping ring given in Table 1 below.

The lubricant was of the type known by the reference Paraliq P12 from Klüber (colorless oil based on paraffin). It was deposited by means of an automatic device normally used in cap-production factories. The blank-clamp pressure was adjusted so as to obtain a preform stamped without any fold.

The drawing step was implemented on the stamped preforms obtained according to the stamping step as described above, with tools having the following characteristics (BUP 200): diameter of the punch of 33 mm and diameter of the drawing ring given in Table 1 below. All the caps tested made it possible to obtain a layer of varnish that was constant and intact over the entire length of the skirt following the copper sulfate test as described above.

For each of the caps, the thickness and the height of the skirt were measured by means of a micrometer, make Mitutoyo, model 395-271-30. The thickness of the skirt of each cap was measured at the dashes that can be seen in FIG. 5. Table 1 below shows the stamping and drawing conditions as well as the results obtained.

TABLE 1

| External varnish | Cap. 1 White polyester (Actega RP1012) | Cap. 2 White polyester (Actega RP1012) | Cap. 3 Glossy polyester | Cap. 4 Matt polyester |
|---|---|---|---|---|
| Initial thickness E0 (μm) | 238 | 238 | 224 | 227 |
| Diameter of stamping ring (mm) | 34.32 | 33.83 | 34.32 | 33.83 |
| Thickness after stamping (μm) | 299 | 311 | 282 | 293 |
| Diameter of drawing ring (mm) | 33.38 | 33.38 | 33.30 | 33.30 |
| Thickness after drawing (μm) | 211 | 217 | 167 | 166 |
| Reduction in thickness (%) | 11 | 9 | 25 | 26 |

Measurements of the thickness of the skirt of the various caps tested (such as those illustrated in FIG. 2) were made with a Mitutoyo micrometer model 395-271-30. FIG. 2, and in particular the curves corresponding to the caps Cap.2 and Cap.3 obtained according to the present invention illustrate clearly the reduction in thickness of the wall of the skirt of the caps, comparing with the thickness of the wall for the cap Cap.1 obtained with only one stamping step, without drawing.

Thus the examples illustrate a possible reduction in the thickness of the skirt of 9 to 26%, while keeping the quality of the layer of varnish over the entire length of the skirt. These reductions in thickness can lead to a reduction in the quantity of metal of the order of 8 to 22%.

Moreover, various tests on manufacturing a cap according to the present invention were implemented. They made it possible to obtain caps where the length of the skirt was respectively 70 mm, 72 mm, 76.8 mm, 78.5 mm and even 78.7 mm.

With regard to the thickness and the quality of the layer of varnish before stamping and drawing, the sheets tested were cut. A plurality of cuts were made. For each cut, a plurality of samples were cut and stacked one on the other.

With regard to the thickness and the quality of the layer of varnish after stamping and drawing, the caps tested were cut longitudinally. A plurality of longitudinal cuts were made.

The various samples were enrobed in a resin and polished, and were then observed under optical microscope. The measurements of thickness of the external varnish were made on the micrographs obtained. An example of a micrograph obtained is shown in FIG. 6. FIG. 6 is a sample before stamping and drawing. The micrograph in FIG. 6 shows that the observation of the various layers (internal and external varnish, metal and resin) and the measurement of the thickness of the external varnish can be done easily since the various layers are clearly visible and have a sharp separation.

The results obtained with regard to thickness of the external varnish are set out in Table 2 below, in micrometers.

TABLE 2

| | | Cap. 1 | Cap. 2 | Cap. 3 | Cap. 4 |
|---|---|---|---|---|---|
| Thickness | Before | 8.0 | 8.0 | 9.5 | 6.5 |

TABLE 2-continued

| | | Cap. 1 | Cap. 2 | Cap. 3 | Cap. 4 |
|---|---|---|---|---|---|
| of external varnish (μm) | stamping and drawing | | | | |
| | After stamping and drawing | 5.6 | 7.1 | 7 | 6.1 |

For each value of varnish thickness, 20 measurements were made, level with the dashes that can be seen in FIG. 5. All the measurements were therefore made simultaneously at the same distance from the top of the cap skirt. The standard deviation of the 20 measurements was 0.77 μm at a maximum.

In addition to the measurements of thicknesses made, the micrographs of the cross sections after stamping and drawing made it possible to see the continuity of the internal and external varnish all along the skirt of the cap.

The invention claimed is:

1. A method for manufacturing one or more metal sealing caps comprising successively:

a) providing a strip or sheet, of aluminum alloy, having a roughness Ra in accordance with NF EN ISO 4287 standard (December 1998) of 0.2 to 0.8 μm, coated on both faces thereof with a layer of varnish;

b) conducting a first cutting operation to obtain disks referred to as blanks;

c) a stamping said blanks, in one or more passes, optionally using a stamping lubricant, so as to form a stamped preform, comprising a head and a skirt;

c') at least one drawing comprising passing the stamped preform through at least one drawing ring in order to lengthen the metal and make said metal thinner, so as to form a cap comprising a head and a skirt, the top of the cap being on a head side and a bottom of the cap on a side where the skirt ends, the skirt having a constant thickness of 0.12 to 0.27 mm, over at least 20% of the length thereof starting from the bottom of the cap, and comprising the continuous layer of varnish intact over an entire length of the skirt, on both inside and outside of the cap, wherein the skirt of the cap has a length of 40 to 85 mm;

d) optionally degreasing said cap;

e) optionally printing and/or finishing varnishing for protection and/or decoration.

2. The method according to claim 1, wherein the head of the cap has a diameter of 20 to 40 mm.

3. The method according to claim 1, wherein the blank has a diameter of 80 to 96 mm.

4. The method according to claim 1, wherein a drawing rate (1−final thickness E/initial thickness EO) is greater than or equal to 0%.

5. The method according to claim 1, wherein a drawing rate is less than or equal to 30%.

6. The method according to claim 1, wherein the varnish used for the inside of the cap is an acrylic varnish.

7. The method according to claim 6, wherein the varnish used for the inside of the cap has a spread of 2 to 6 $mg/m^2$, and a thickness of 1 to 6 μm.

8. The method according to claim 1, wherein the varnish used for the outside of the cap is a polyester varnish.

9. The method according to claim 8, wherein the varnish used for the outside of the cap has a spread of 3 to 17 $mg/m^2$, and a thickness of 4 to 12 μm.

10. The method according to claim 1, wherein the stamping and drawing are concatenated without any other intermediate step.

11. The method according to claim 1, wherein the last stamping and the drawing are implemented in a single press stroke.

12. The method according to claim 1, wherein a punch is used for the stamping and the drawing, the punch having two different diameters over the length thereof, a first diameter D1 corresponding to a part of the punch coming into contact first with the metal to be stamped and then drawn and a second diameter D2 corresponding to a part of the punch coming into contact secondly with the metal to be stamped and then drawn, the two parts having different diameters being connected together by a conical transition part, the first diameter D1 being less than the second diameter D2, the difference in diameter between first diameter D1 and second diameter D2 being 0.02 to 0.1 mm.

13. The method according to claim 12, wherein the first diameter D1 and the second diameter D2 are from 19 to 39.6 mm.

14. The method according to claim 12, wherein the part having the first diameter D1 represents from 25 to 35% of the height of the punch, and the part having the second diameter D2 represents from 60 to 70% of the height of the punch.

15. The method according to claim 12, wherein the conical transition part represents from 3 to 7% of the height of the punch.

16. The method according to claim 1, wherein the stamped preform has a diameter of 27 to 31 mm and/or a thickness of 0.15 to 0.35 mm.

17. The method according to claim 1, wherein the head has a thickness of 0.15 to 0.35 mm.

* * * * *